US005713086A

United States Patent [19]

Diethelm

[11] Patent Number: 5,713,086

[45] Date of Patent: Feb. 3, 1998

[54] FLUSHING DEVICE FOR A TOILET

[75] Inventor: Alois Diethelm, Vorderthal, Switzerland

[73] Assignee: Geberit Technik AG, Jona, Switzerland

[21] Appl. No.: 431,139

[22] Filed: Apr. 28, 1995

[30] Foreign Application Priority Data

May 16, 1994 [CH] Switzerland ..... 1509/94

[51] Int. Cl.[6] ..... E03P 1/14

[52] U.S. Cl. ..... 4/325; 4/389; 4/391

[58] Field of Search ..... 4/324, 325, 379, 4/388, 389, 390, 391, 394, 410, 402

[56] References Cited

U.S. PATENT DOCUMENTS

| | | | |
|---|---|---|---|
| 341,372 | 5/1886 | Bryan | 4/389 |
| 5,070,547 | 12/1991 | Comparetti | 4/325 |
| 5,105,480 | 4/1992 | Howell et al. | 4/402 X |
| 5,305,474 | 4/1994 | Nardi et al. | 4/324 |
| 5,349,981 | 9/1994 | Schmucki et al. | 4/391 X |
| 5,392,470 | 2/1995 | Johnson | 4/325 |

FOREIGN PATENT DOCUMENTS

| | | | |
|---|---|---|---|
| 0648189 | 2/1993 | Australia | 4/390 |
| 2 678 968-A1 | 1/1993 | France . | |
| 36 18 671 | 1/1987 | Germany . | |

OTHER PUBLICATIONS

European Search Report dated Nov. 28, 1996.

*Primary Examiner*—Robert M. Fetsuga
*Attorney, Agent, or Firm*—McGlew & Tuttle

[57] ABSTRACT

A flushing device has a first pushbutton for triggering a flushing with essentially the total amount of water present in the flushing tank and a second pushbutton for triggering a flushing with part of this amount of water. Both pushbuttons are connected to a valve pipe, which is to be raised during flushing and is mounted in a float housing. A beaker-shaped hollow body, which is raised as an additional weight with the closing element in the case of a partial flushing, is arranged in the flushing tank. The hollow body is raised with the closing element during a complete flushing and during a partial flushing alike. In the case of a complete flushing, the hollow body is opened by an opening such that water contained in the said hollow body flows out at least partially when the closing element with the hollow body is raised. In the ease of a complete flushing, the emptied hollow body does not represent an essential additional weight, which could force the valve pipe onto the valve seat against the buoyancy of the float.

6 Claims, 4 Drawing Sheets

16
15
4
3
14
47
2
27
7
1
13
12
25
26
48
11
8
9
6
10
5
18
19

16
15
4
3
14
2
27
7
1
13
12
26
25
8
11
9
22
20
47
10
5
21
18
19

FLUSHING DEVICE FOR A TOILET

FIELD OF THE INVENTION

The present invention pertains to a flushing device for a toilet, with a first pushbutton for triggering a flushing with essentially the total amount of water present in a flushing tank and a second pushbutton for triggering a flushing with part of this mount of water, wherein both pushbuttons are connected to a closing element that is to be raised during flushing, and a beaker-shaped hollow body, which is raised as an additional weight with the closing element in the case of partial flushing, is arranged in the flushing tank.

BACKGROUND OF THE INVENTION

A flushing device of this class has been known from the Applicant's Pat. No. DE-C-36 18 671. In this device, the beaker-shaped hollow body is placed on the housing of a float valve in the state of rest, and it is connected to the valve body when a partial flushing is triggered and loads this valve body when it is raised after the flushing has been triggered. Thus, in the case of a partial flushing, the water-filled hollow body forms an additional weight, which brings the overflow pipe into the closed position before the total amount of water present in the flushing tank has escaped from the tank body. In the case of a complete flushing, the hollow body remains on the housing of the float valve. This prior-art flushing device has the drawback that an expensive and relatively trouble-prone lever mechanism is necessary for the connection.

SUMMARY AND OBJECTS OF THE INVENTION

The basic object of the present invention is to provide a flushing device of the type described, which has a simpler design and yet is reliable in operation.

The present invention is embodied in a flushing device of the type described by the hollow body also being raised with the closing element even during a partial flushing and by the hollow body being opened by means of an opening means in the case of a complete flushing, such that the water contained in it flows out when the closing element with the hollow body is raised. A connecting means is not necessary in the flushing device according to the present invention, because the hollow body is raised with the closing element during complete flushing and partial flushing alike, and it can be rigidly connected to same. The flushing device can be prepared with fewer individual parts at a lower cost and essentially in a purely hydraulic manner. It is also advantageous that the float housing does not have to be replaced in existing flushing devices, because the hollow body is not placed on it, unlike in the prior-art device. An especially simple embodiment of the flushing device according to the present invention is obtained if, according to a variant, the cone or collar of the beaker-shaped hollow body is lifted off from its bottom during a complete flushing, so that an opening, through which water present in the hollow body can flow out relatively rapidly, is formed between the cone and the bottom. The bottom of the hollow body can be rigidly connected to, e.g., interlocked with, the closing element, which makes possible an especially inexpensive manufacture and assembly.

It is particularly advantageous if, according to a variant of the present invention, a second beaker-shaped hollow body is arranged on the closing element above the hollow body, and this second hollow body maintains the raised hollow body cone or collar in a state of floating by a vacuum action at least until the water present in the hollow body has essentially run out. According to an alternative design, the bottom of the hollow body has a beaker-shaped design, and a second bottom, which maintains the cone in the state of floating at least until the water present in the hollow body has essentially run off, is arranged on the cone to be raised.

Other advantageous features will appear from the following description, as well as the drawing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
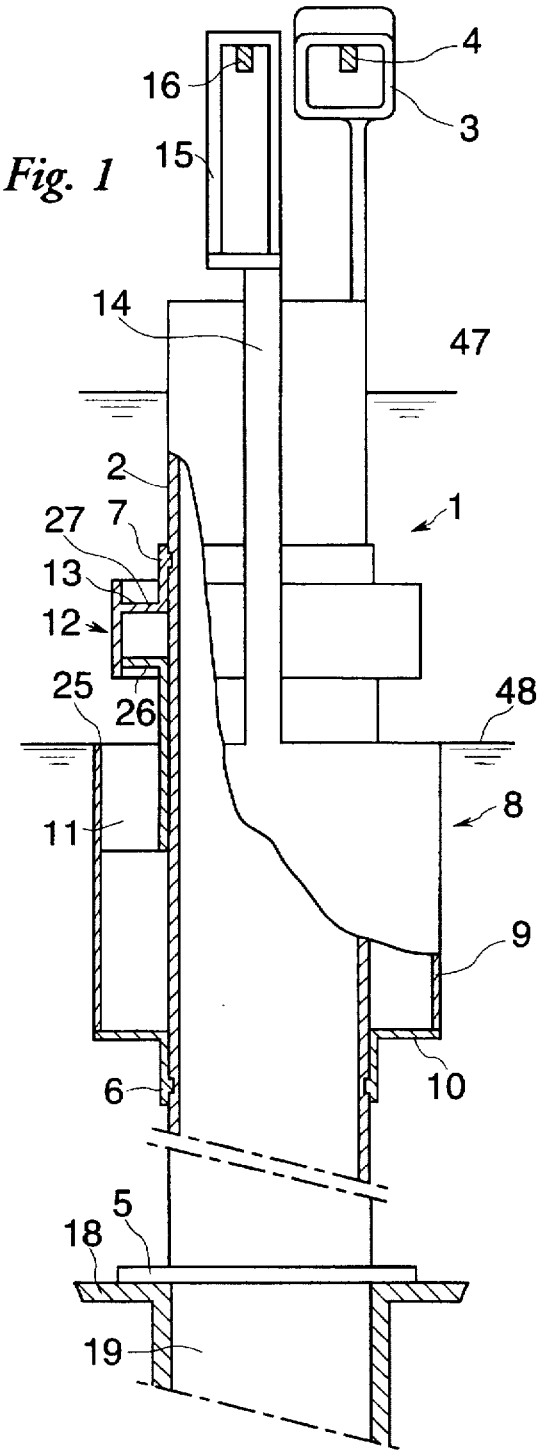
FIG. 1 is a partially cutaway view of a device according to the present invention in its starting position.
Figure 6:
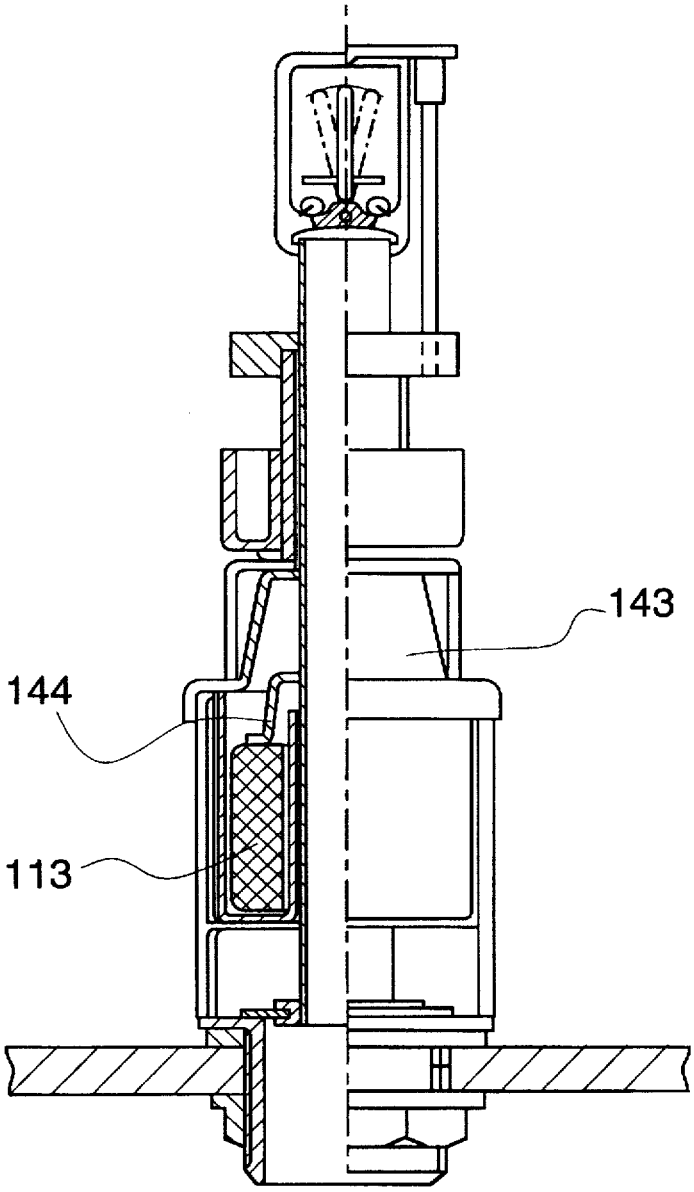
Fig. 6 (PRIOR ART)
FIG. 6 is a prior art flushing device.

FIG. 1 shows a section of a flushing tank 18 with a discharge opening 19, which is closed by means of a valve disk 5 of a valve pipe 2, so that the flushing water 47 present in the tank body of the flushing tank 18 cannot flow out through the opening 19. The valve pipe 2 is mounted in a float valve, e.g., one known from DE-C-36 18 671, and shown in prior art FIG. 6, with the prior art float valve including elements 113, 143 and 144, and with a selective triggering mechanism being shown at the top of the figure. A strap 3, which is engaged by an arm 4 of a pushbutton mounted in the flushing tank, is arranged at the top end of the valve pipe 2, which may also be used as an overflow pipe at the same time. By pivoting the pushbutton, the valve pipe 2 with the valve disk 5 can be raised, and the opening 19 can be released for triggering the flushing. A beaker-shaped hollow body means 8, which is connected to the valve pipe 2 and is filled with water, is raised with the valve pipe 2. As soon as the flushing water 47 has dropped approximately below the level indicated by the line 48, the hollow body 8 with the water contained in it loads the valve pipe 2 as an additional weight, and causes the discharge opening 19 to be closed before all the flushing water 47 has run out of the flushing tank 18. The arm 4, and strap 3, form a reduced volume triggering means for flushing an amount of liquid which is a part of the total amount of water in the tank.

To trigger a complete flushing, the arm 16 is pivoted with a second pushbutton, and a strap 15 and, together with it, the cone or collar 9 of the hollow body 8, are raised as a result. The cone or collar 9 now separates from the bottom 10, which bottom 10 is rigidly connected to the valve pipe 2 by means of a snap-in connection 6. As a result, a relatively large, circular opening 22 (FIG. 2), through which the water present in the hollow body 8 can flow out relatively rapidly as soon as the level of the flushing water 47 drops below the top edge 25 of the cone or collar 9, is formed between the cone 9 and the bottom 10. In order for the cone 9 to be maintained in the state of floating in the raised position shown in FIG. 2 at least until the water present in the hollow body 8 has run off, an additional beaker-shaped hollow body 12 is arranged on the valve pipe 2 above the cone 9 by means of a snap-in connection 7. With the cone 9 raised, an annular projection 26 of a guide part 11, which projection extends to the outside, engages the hollow body 12 and is in contact with a bottom 27. When the pushbutton of the lever 16 is released, the cone 9 is held in the hollow body by the vacuum in the hollow body 12. The annular projection 26 and the bottom 27 thus form a holding means. The vacuum under the bottom 27 is slowly eliminated through a small opening 13 in the bottom 27, so that the cone 9 drops back onto the bottom 10 after a predetermined time. Another effect of the beaker-shaped hollow body 12 is that the valve pipe 2 is also raised by means of the arm 16 during the raising of the cone 9 as soon as the projection 26 comes into contact with the bottom 27 of the hollow body 12. The lever 16, and the strap 15 interact with the reduced volume trigger means to form a full volume trigger means for flushing essentially a total amount of water in the tank.

Figure 2:
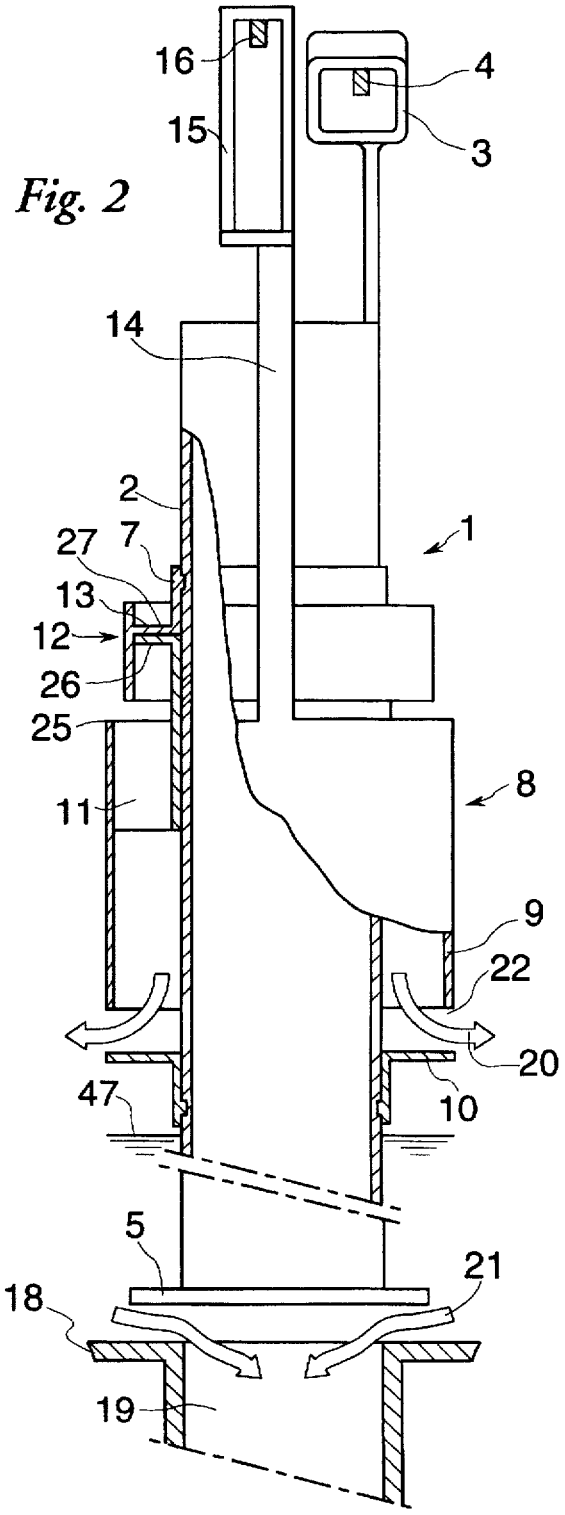
FIG. 2 is a view similar to FIG. 1, showing the device according to FIG. 1, but with the discharge valve open in the state of a complete flushing.

When a complete flushing is triggered, the cone 9 is thus first raised to form the opening 22, and the valve pipe 2 is additionally also raised with a continued movement of the arm 16, and the discharge opening 19 is opened as a result. Unit 1 is shown in FIG. 2 in the state of a complete flushing. The valve pipe 2 is raised now, so that flushing water can flow in the direction of the arrows 21 through the opening 19 and into the toter bowl, not shown here. The cone 9 is raised, and vacuum is maintained in the hollow body 12. The water contained in the hollow body 8 has flown out at least extensively through the opening 22 in the direction of the arrows 20, so that the hollow body 8 does not represent an appreciable weight, and the valve pipe 2 is maintained in a state of floating by the float valve until complete emptying of the flushing tank. After complete emptying of the flushing tank, the cone 8 falls back onto the bottom 10, and water flows over the edge 25 into the hollow body 8 and refills it during the refilling of the flushing tank. The flushing tank is then again ready for a complete or partial flushing.

Figure 3:
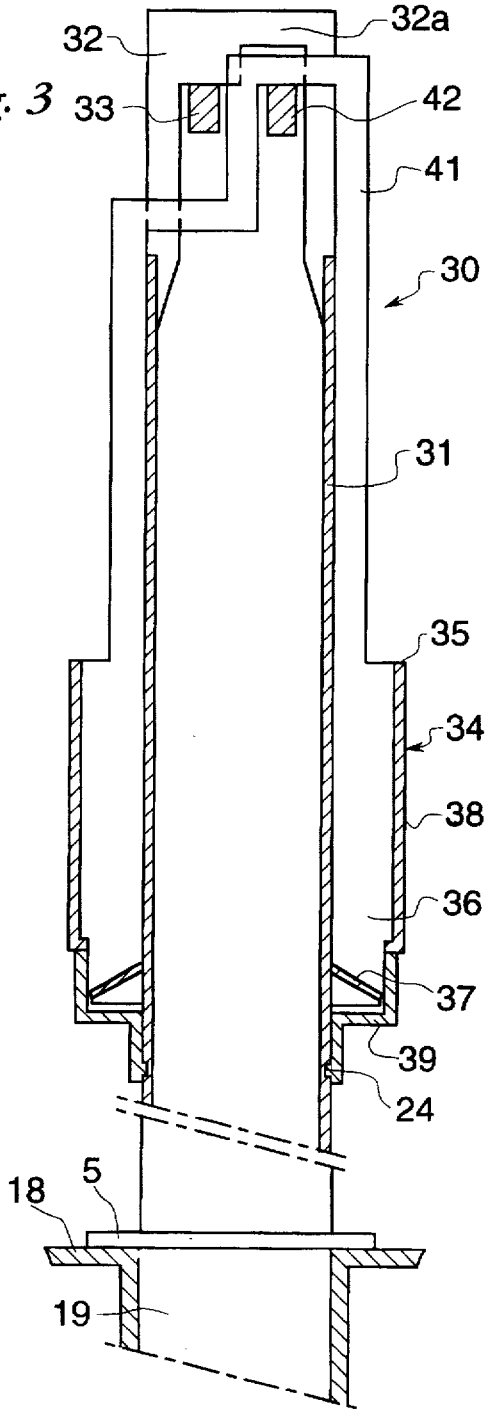
FIG. 3 is a partially cutaway view of a device according to another embodiment of the invention.
Figure 4:
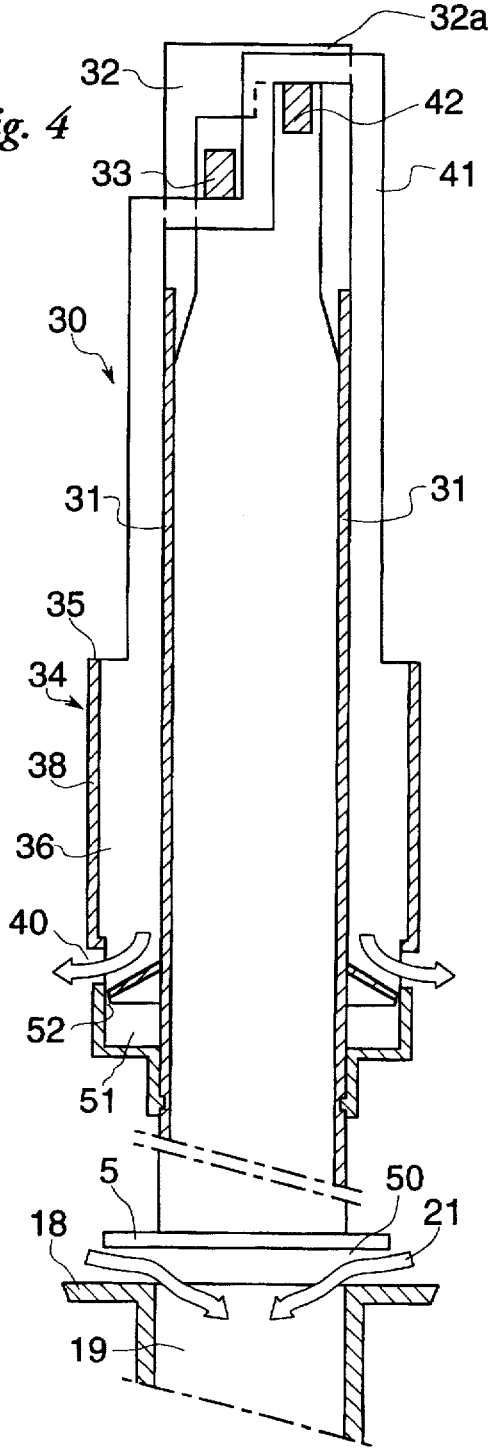
FIG. 4 is a view according to FIG. 3, but with the discharge valve open during a complete flushing.
Figure 5:
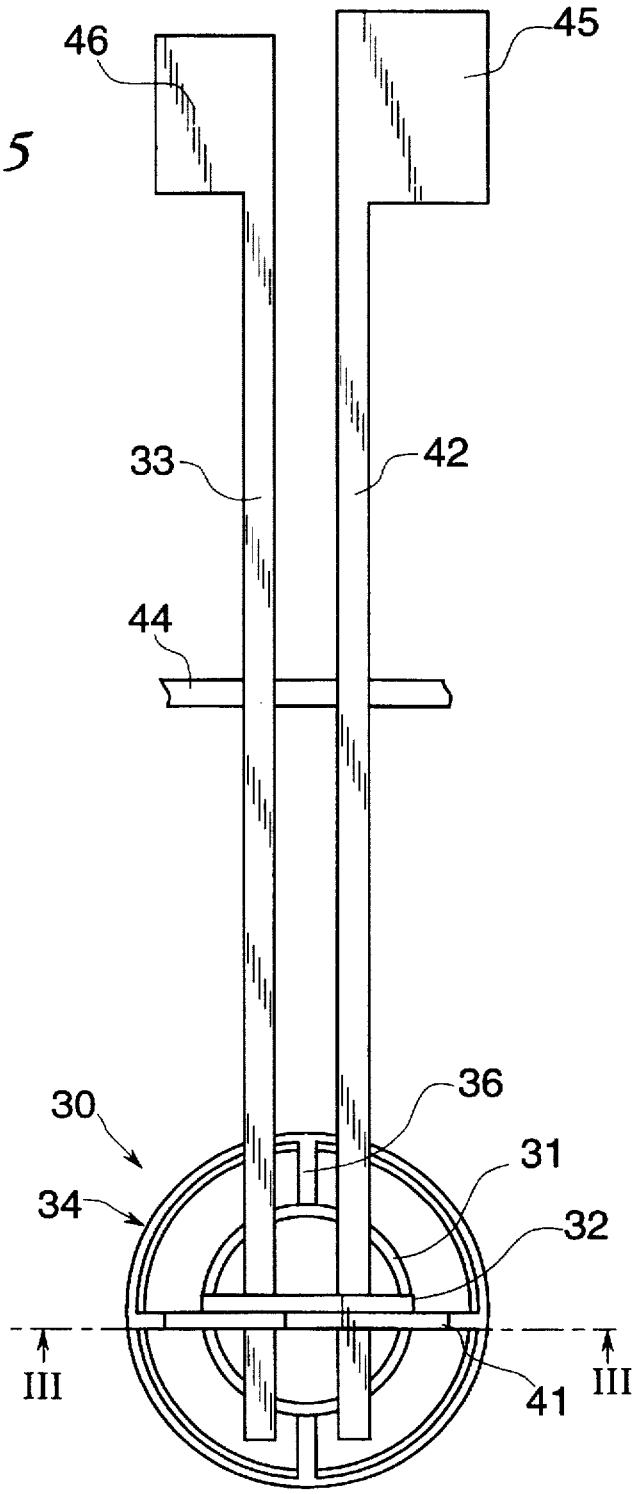
FIG. 5 is a top view of the device according to FIG. 3.

In the embodiment according to FIGS. 3 through 5, a unit 30 with a valve pipe 31 acting as a closing element and with a hollow body 34 arranged thereon and acting as an additional weight are arranged. A U-shaped strap 32, which is engaged by an arm 33 of a pushbutton 46 for triggering a partial flushing and by an arm 42 of a pushbutton 45 for triggering a complete flushing, is made in one piece with the top end of the valve pipe 31. The arm 42 for the complete flushing also engages at the same time a strap 41, which is made in one piece with the cone 38 of the hollow body 34. A bottom 39 is designed in the shape of a beaker, and it is rigidly connected to the valve pipe 31 by means of a snap-in means 24.

The pushbuttons 45 and 46 may be mounted pivotably on a web 44 of the flushing tank, e.g., according to FIG. 5.

To trigger a complete flushing, the arm 42 is pivoted upward by its free end by means of the pushbutton 45, and the cone or collar 38 is thus first raised with the strap 41. A relatively large, circular gap 40 shown in FIG. 4 is thus formed between the cone 38 and the bottom 39. If the arm 42 is raised farther in the same direction, so that it comes into contact with a cross web **32*a* of the strap 32, the valve pipe 31 is additionally raised with the cone 38, and the valve disk 5 is lifted off from the seat of the discharge opening 19. Water contained in the flushing tank flows through the opening 50 thus formed into the toilet bowl, not shown here, in the direction of the arrows 21. As a result, the level of the flushing water in the flushing tank 18 drops relatively rapidly. As the level in the flushing tank drops below the level of the opening 40, the water contained in the hollow body 34 flows out into the flushing water relatively rapidly. The hollow body 34 thus loses weight very rapidly. The valve pipe 31 is maintained in the state of floating by the prior-art float valve, not shown here, until the flushing tank 18 has been completely emptied. The relatively light weight of the emptied hollow body 34** cannot overcome the buoyancy of the float valve.

In order for the cone 38 not to fall back immediately onto the bottom 39, thereby closing the opening 40, when the pushbutton 45 is released, the cone 38 has, at webs 36, a circular or collar bottom 37, which engages the beaker-shaped bottom 39 from the top. The cone 38 is maintained in the state of floating until the water present in an annular space 51 under the collar bottom 37 has escaped through a circular gap 52. The gap 52 is adjusted such that the cone 38 is maintained in the state of floating at least until the flushing tank 18 has been completely emptied.

The valve pipe 31 falls back on the valve disk after the emptying of the flushing tank 18, after which the flushing tank 18 is refilled by means of an inlet valve, not shown here. The cone 38, which has meanwhile fallen back, closes the opening 40, so that water flowing in over the edge 35 refills the hollow body 34. As soon as the flushing tank 18 has been filled up, it is again ready for a complete or partial flushing.

For a partial flushing, the free end of the arm 33 is pivoted upward by means of the pushbutton 46, so that the valve pipe 31 is raised together with the hollow body 34 and the water contained therein. Since the opening 40 remains closed, the hollow body 34 acts as an essential additional weight, which forces the valve pipe 31 to move prematurely in the downward direction onto the valve seat.

While specific embodiments of the invention have been shown and described in detail to illustrate the application of the principles of the invention, it will be understood that the invention may be embodied otherwise without departing from such principles.

What is claimed is:

1. Flushing device for a flushing tank, comprising:

a closing element positionable within the tank for closing a discharge opening of the tank;

a hollow body connected to said closing element and providing an additional weight said hollow body with said additional weight being raised with said closing element, said hollow body having means for containing a portion of water in said hollow body and said portion of water providing said additional weight to said hollow body, said hollow body being beaker-shaped, a collar and a bottom being provided with said hollow body;

first triggering means for triggering a flushing with essentially a total amount of water present in the flushing tank, said first triggering means being connected to said hollow body for causing said portion of water to be released from said hollow body whereby said additional weight is removed from said hollow body, said first triggering means lifting said collar off said bottom whereby water present in said hollow body can flow out relatively rapidly between said collar and said bottom;

second triggering means for triggering a flushing with part of the total amount of water present in the flushing tank said second triggering means being connected to said closing element and causing said portion of water to be retained in said hollow body during a partial flushing.

2. Flushing device according to claim 1, wherein said bottom is rigidly connected and interlocked with said closing element.

3. Flushing device according to claim 1, further comprising holding means connected to said hollow body for maintaining said raised hollow body in a floating state, until water present in said hollow body has essentially run off, said holding means being arranged on said closing element above said hollow body.

4. Flushing device according to claim 3, wherein said holding means includes vacuum action means for maintaining said raised hollow body in said floating state.

5. Flushing device according to claim 3, wherein said holding means is beaker-shaped and maintains said raised hollow body in a floating state via vacuum action.

6. Flushing device according to claim 1, wherein:

said collar has a collar bottom;

said bottom of said hollow body has a beaker-shaped design which maintains said collar bottom in a state of floating until said water present in said hollow body has essentially run out.

* * * * *